United States Patent [19]

Fritzinger

[11] 3,935,655

[45] Feb. 3, 1976

[54] VANDAL-PROOF STREET NAME SIGN

[76] Inventor: George H. Fritzinger, 217 W. Grant Ave., Edison, N.J. 08817

[22] Filed: Aug. 12, 1974

[21] Appl. No.: 496,706

[52] U.S. Cl. ..... 40/145 R

[51] Int. Cl.² ..... G09F 07/18

[58] Field of Search ..... 40/145 R, 125 H, 125 R, 40/131 R

[56] References Cited

UNITED STATES PATENTS

| | | | |
|---|---|---|---|
| 800,031 | 9/1905 | Travis | 40/145 R |
| 1,684,470 | 9/1928 | Butler | 40/145 R |
| 1,902,511 | 3/1933 | McDaniel | 40/145 R |
| 1,918,571 | 7/1933 | Sheras | 40/145 R |
| 1,944,498 | 1/1934 | Crick | 40/145 R |
| 1,974,998 | 9/1934 | Wright | 40/145 R |
| 2,125,475 | 8/1938 | Weigele et al. | 40/145 R |

*Primary Examiner*—Louis G. Mancene
*Assistant Examiner*—John F. Pitrelli
*Attorney, Agent, or Firm*—George H. Fritzinger

[57] ABSTRACT

A street name sign comprising one or more sign heads of a hollow, aluminum-frame construction mounted on a post cap via a center staff and a nut threaded thereon against the post cap is provided with a vandal-proof arm secured to the center staff, which is anchored deep in the cylindrical post or pipe supporting the sign to render the sign vandal-proof against unauthorized removal from the post and against being bent or broken by a yanking on the ends of the sign ends by one's full strength and weight. The vandal-proof arm may comprise a threaded extension of the center staff secured thereto through a staff nut used also to clamp the post cap to the sign heads, or preferably it may be an integral extension of the center staff having a one-way spring-lock washer thereon acting through a compression spring against the post cap to clamp the same to the sign heads.

Vandalism of street name signs has become a growing menace by vandals bending or breaking the signs loose from the posts and even removing the entire signs and carrying them away. Another difficulty heretofore sometimes encountered, not however of a vandal-related nature, is a "freezing" of the nut on the aluminum center staff due to corrosion arising from many years exposure to the weather, especially salt-air conditions, which prevents a disassembling of the sign structure for repair.

8 Claims, 6 Drawing Figures

VANDAL-PROOF STREET NAME SIGN

An object of the invention is to provide an improved street name sign of the hollow-head construction having a solidrod aluminum center staff running through the head and post cap wherein the staff is provided with a solid-rod extension anchored in the post to render the sign vandal-proof against unauthorized removal and against being bent or broken by heavy tilting or twisting force exerted on the sign head.

Another object is to provide such improved street name sign which is safeguarded against unauthorized removal and from falling accidentally with possible injury to a passerby should the post be rocked or bent sidewise.

Another object is to provide such improved sign construction wherein the vandal-proof arm is threaded into the nut which also is threaded to the center staff to clamp the post cap to the sign head.

Another object is to provide the vandal-proof arm with a disk staked thereto which engages the inside wall of the post with a clearance fit to remove stress from the post cap should the sign head be tilted heavily sidewise, and further it is an object to provide a pin or bolt in the post above the disk to prevent unauthorized removal of the sign.

Another object is to provide an improved street name sign of the character described wherein the vandal-proof arm is an integral extension of a solid-rod center staff and wherein the post cap is clamped to the head by a one-way spring lock on the staff.

Another object is to provide such spring lock which can be readily released by an authorized repairman, and which is of a stainless steel construction not subject to rust or corrosion from long exposure to weather, even salt-air conditions.

These and other objects and features of the invention will be apparent from the following description and the appended claims.

In the description of my invention reference is had to the accompanying drawings, of which:

Figure 1:
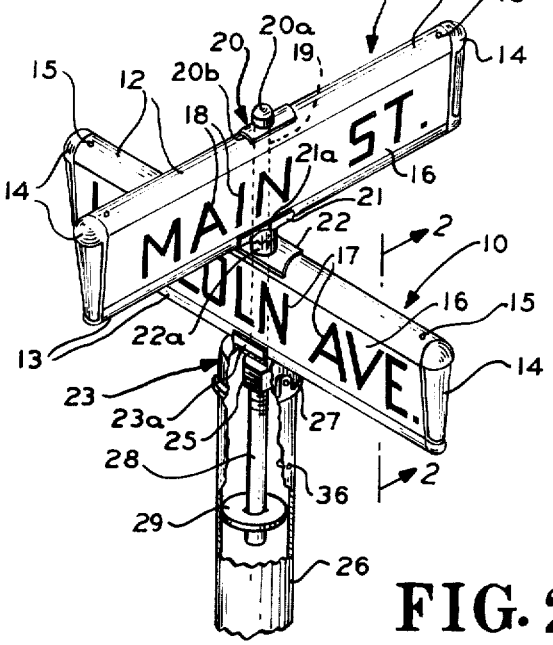
FIG. 1 is a perspective view of a street name sign with a portion of the post cap and post broken away, showing a vandal-proof arm secured to the center staff by threaded engagement with a nut on the staff according to one embodiment of the invention.

The present street name sign comprises a sign head structure which may include a sign head 10 to designate a single street, or two such sign heads 10 and 11 (FIG. 1) to designate the two streets at a crossing. All components are typically made of aluminum except the screws which are of stainless steel. Each sign head comprises an upper extrusion 12 semicylindrical in cross section having grooved edges 12*a* (FIG. 2), and a bottom extrusion 13, also semicylindrical in cross section but of reduced diameter, having grooved edges 13*a*. These extrusions receive end caps 14 held thereto by screws 15. Engaging the grooved edges of the top and bottom extrusions of each sign head is a pair of name panels 16 which are telescoped in place after one of the end caps is assembled and which become locked in position after the second end cap is assembled to form thus a hollow frame construction. The name panels are typically faced with a reflective sheet material and are printed with legends 17 and 18 typically by a silk-screen process.

The top and bottom extrusions are apertured midway the length thereof to receive an aluminum center staff 19 of a solid-rod construction for maximum strength. At the top of the sign a top cap 20, having an internally-threaded dome 20a, is threaded onto the upper end of the center staff. This top cap has side wings 20*b* arcuate in cross section to engage evenly the top extrusion. Between the sign heads there is a crisscross set of winged members 21 and 22 also arcuate in cross section to engage respectively the lower extrusion of the upper sign head and the top extrusion of the bottom sign head. These parts have central tubular extensions 21*a* and 22*a* which receive the center staff and which interengage at 45° intervals so that the sign heads can be set either at 45° or at 90° to each other. At the bottom of the lower sign head there is a post cap 23 having a center hole receiving the center staff and a top arcuate wall portion 23*a* engaging the bottom extrusion. A nut 25 threaded on the lower end of the center staff against the post cap serves to clamp the whole sign structure into an integral unit. This cap is open at the bottom and of a diameter to fit with suitable clearance the upper end of a cylindrical post or pipe 26 mounted in the ground ground support the sign at a suitable elevation. Several pointed set screws 27 — typically 3 — are threaded through the wall of the cap and tightened into engagement with the post to hold the sign in place.

It is the customary practice in the sign field to secure the sign on the post only by the engagement of the post cap with the post and by a tightening of the pointed set screws. This, however, leaves the sign subject to easy vandalism because a tilting force on the sign will displace it sidewise and, if a strong force is exerted and the post cap is held fast by the set screws being in a highly tightened condition, the high-leverage strain on the cap will break it. In the present type of sign the center staff itself reenforces the sign heads against being bent or broken. The extending of this center staff and the anchoring of it in the post in accordance with the invention serves to take the strain off the post cap if a vandal endeavors to tilt the sign sidewise by his weight, and since the center staff is a solid rod typically three-fourths inch in diameter the sign has sufficient strength to withstand the full weight of a grown person so that the sign is not bent or broken.

Figure 2:
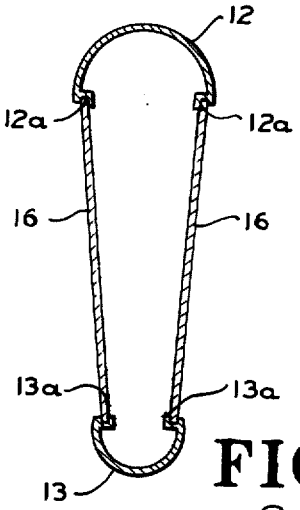
FIG. 2 is a section on the line 2—2 of FIG. 1.
Figure 3:
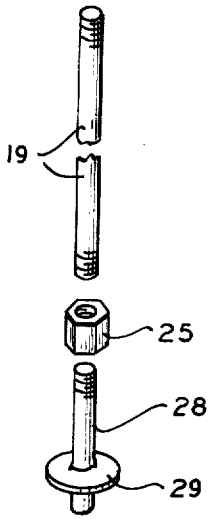
FIG. 3 is an exploded view showing only the center staff, nut and vandal-proof arm of the embodiment of FIG. 1.

In the embodiment of the invention shown in FIGS. 1 and 2, the nut 25 is relatively long — typically about 1 1/4 inch – and the length of the center staff is such that the nut clamps the post cap tightly against the sign head when it is threaded about half its length onto the center staff. A vandal-proof arm 28 comprising about a 5 inch length of the center staff rod material is threaded into the lower half of the nut 25 tightly against the bottom end of the center staff and has a disk 29 staked to the lower end which engages the inside wall of the post with a clearance fit. In this construction the vandal-proof arm is substantially an integral extension of the center staff itself to provide sufficient strength to prevent the sign structure from being bent or broken.

However, difficulties which increase production cost in the above construction arise from the use of a long special nut, the need for an extra cutting of the rod stock forming the vandal-proof arm separate from the center staff, and the need to thread both of the mating ends of the staff and arm. Still further, the use of a nut threaded on the staff tightly against the post cap is subject to corrosion, especially in salt-air conditions, which tends to "freeze" the nut to the staff after many years' exposure to the weather.

Figure 5:
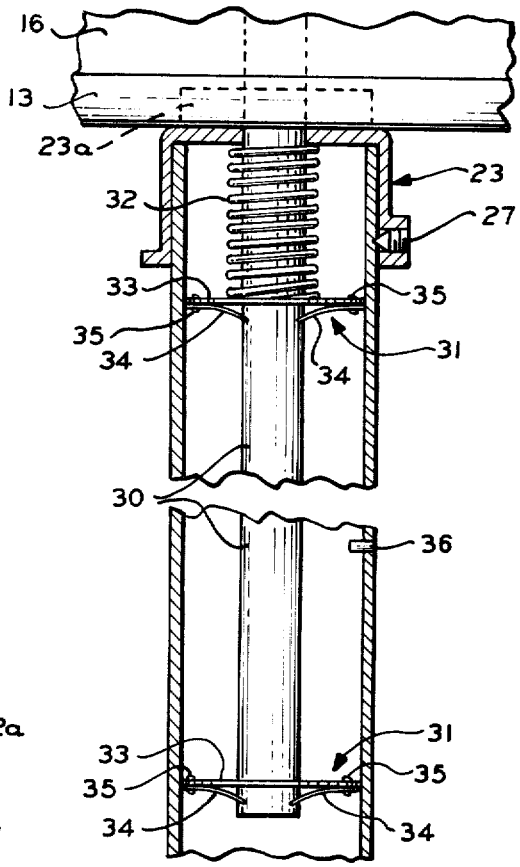
FIG. 5 is a fractional side view partly in section and to larger scale showing the alternate construction of center staff and spring lock holding the sign assembled.
Figure 4:
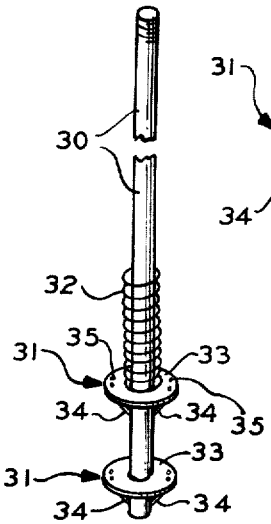
FIG. 4 is a view of an alternate form of center staff having an integral extension forming the vandal-proof arm and having a one-way spring lock thereon adapted to be pressed through a compression spring against the post cap to clamp the sign structure into an integral unit.
Figure 6:
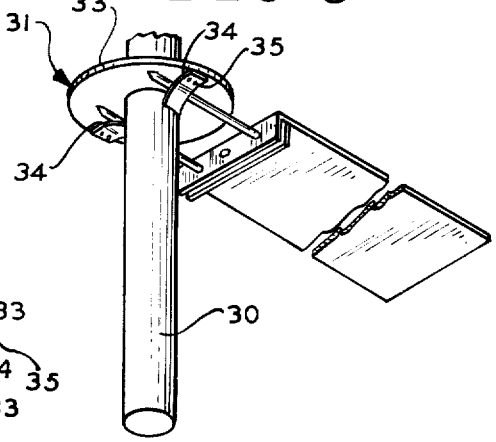
FIG. 6 is a view showing a forked release tool in engaged relation with the spring-lock washer to disengage the lock from the center staff.

In the alternative embodiment shown in FIGS. 4–6, the aforestated cost and corrosion difficulties are overcome by the use of a center staff 30 of an extended length adapted to serve also as the vandal-proof arm, and by the use of a special one-way spring-lock collar 31 on the center staff, in place of a threaded nut as in the foregoing construction, which is not subject to corrosion or to impairment from long exposure to the weather. In this alternative embodiment the spring-lock collar is pressed along the center staff into a locked position to exert the desired clamping pressure against the post cap through a spring 32. The spring-lock collar comprises a washer 33 slidable freely on the center staff, having two diametrically opposite cantilever springs 34 each secured to the border portion of the washer by two rivets 35. These are flat springs typically 0.015 inch in thickness and one-half inch wide which extend radially inwardly slightly past the center hole. The springs 34 and rivets 35 are of stainless steel so as to be corrosion resistant, and the springs are further of No. 302 material so as to have the desired spring temper. When the spring-lock collar is slid onto the center staff the springs become bowed outwardly at about 25° to the washer such that when pressure is exerted to push the washer in the opposite direction the ends of the springs bite immediately into the center staff to lock the washer against movement. This spring-lock collar is mounted with the springs on the side of the washer away from the post cap and with the compression spring 32 between the washer and the cap. After the post cap 23 and sign heads 10 and 11 with the intermediate crisscross set 21–22 are mounted on the center staff, the top cap 20 is threaded on the center staff and then the spring-lock collar is pressed to exert the desired clamping pressure through the spring 32 against the cap to secure the sign structure into a unitary assembly. In this alternative construction the bottom disk 29 of the previous embodiment may be replaced also by the use of a spring-lock collar 31 as shown.

In order further to deter any unauthorized removal of the whole sign from a post, a pin 36 may be driven into the post between the cap and the disk 29 or collar 31 (FIG. 1). Preferably, this pin should extend only about one-fourth inch past the inside wall. Upon anyone attempting to lift the sign off the post the disk 29 or collar 31 will engage the pin and prevent its removal. However, an authorized person equipped with a ladder enabling him to stand just above the level of the sign will be able to exert sufficient lifting force to bend the disk 29 or collar 31 and thus remove the sign. After the sign is repaired, a new spring-lock collar 31 may be pressed easily onto the lower end of the vandal-proof arm to restore the sign to its original vandal-proof condition before the sign is mounted on the post.

The above embodiments of my invention herein particularly shown and described are intended to be illustrative and not necessarily limitative of my invention since the same are subject to changes and modifications without departure from the scope of my invention, which I endeavor to express according to the following claims:

I claim:

1. In a street name sign: the combination of a sign head structure comprising one or more hollow sign heads each having name panels at the opposite sides thereof, a center staff passing vertically through said head structure, a top cap in interlocking engagement with the upper end of said sign head structure and secured to the upper end of said center staff, a post cap receiving the lower end of said center staff and adapted to fit over the upper end portion of a cylindrical post for supporting said sign at a suitable elevation above the ground, pointed set screws threaded through the side wall of said post cap for locking engagement with the wall of said post, securing means on said center staff tightened against said post cap to clamp said sign head structure between said top cap and said post cap via said center staff, an arm of solid rod stock secured to the lower end of said center staff in substantial extension beyond said post cap and a collar secured to the lower end of said arm for engaging the inside wall of a post supporting said sign with a clearance fit at a substantial distance below said post cap to retain said post cap in upright position on said post and to relieve the post cap from strain tending to break it upon an excessive tilting force being exerted on said sign head structure.

2. The street name sign set forth in claim 1 wherein said securing means comprises a nut threaded externally on said center staff through a fractional length thereof in tightened relation against said post cap, and wherein said arm is threaded into the remaining portion of said nut tight against the end of said center staff to lock the nut in place and with the nut causing said arm to be effectively an integral extension of the center staff.

3. In a street name sign: the combination of a sign head structure comprising one or more hollow sign heads each having name panels at the opposite sides thereof, a center staff passing vertically through said head structure, a top cap in interlocking engagement with the upper end of said sign head structure and secured to the upper end of said center staff, a post cap receiving the lower end of said center staff and adapted to fit over the upper end portion of a cylindrical post for supporting said sign at a suitable elevation above the ground, pointed set screws threaded through the side wall of said post cap for locking engagement with the wall of said post, securing means on said center staff tightened against said post cap to clamp said sign head structure between said top cap and said post cap via said center staff, an arm of solid rod stock secured to the lower end of said center staff in substantial extension beyond said post cap and a collar secured to the lower end of said arm for engaging the inside wall of a post supporting said sign with a clearance fit at a substantial distance below said post cap to retain said post cap in upright position on said post and to relieve the post cap from strain tending to break it upon an excessive tilting force being exerted on said sign head structure, wherein said center staff and arm are of an integral construction, including a locking collar pressed slidably on said staff against said post cap, said collar having locking elements thereon engaging said staff at a critical angle to lock the collar against displacement in directions away from said post cap.

4. The street name sign set forth in claim 3 including a compression spring on said center staff between said post cap and locking collar to permit easy adjustment of said locking collar through a pressure range against said post cap.

5. The street name sign set forth in claim 3 including a second locking collar pressed onto the lower end portion of said center staff adapted to have a clearance fit with the inside wall of said post.

6. The street name sign set forth in claim 3 wherein said locking collar comprises a washer freely slidable on said center staff and said locking elements comprise flat cantilever springs riveted at their outer ends to said collar in positions diametrically opposite to said center staff, said springs being riveted flat against said collar and extending when in a free state into the center hole of said washer, causing the springs to be bowed away from the washer to allow the locking collar to be slid freely in one direction along the center staff, said bowing being only to a critical angle causing the springs to cut immediately into the wall of the center staff to lock the collar when pressed in the opposite direction.

7. The street name sign set forth in claim 6 wherein said springs are made of spring-temper stainless steel free of rust and corrosion after long exposure of the sign to the weather.

8. The street name sign set forth in claim 6 including, in combination, a forked tool engageable with said locking collar between said cantilever springs and washer to pry the springs out of locking engagement with said center staff.

* * * * *